United States Patent [19]

Ricketts

[11] 4,245,865

[45] Jan. 20, 1981

[54] EXPLOSIVE EXPANSION TO A LIMITED VOID WITH UNIFORM SCALED DEPTH OF BURIAL

[75] Inventor: Thomas E. Ricketts, Grand Junction, Colo.

[73] Assignee: Occidental Oil Shale, Inc., Grand Junction, Colo.

[21] Appl. No.: 79,877

[22] Filed: Sep. 28, 1979

[51] Int. Cl.[3] ..... E21B 43/247; E21B 43/263

[52] U.S. Cl. ..... 299/2; 166/259; 299/13

[58] Field of Search ..... 166/256, 259, 299, 247; 299/2, 13; 102/22, 23

[56] References Cited

U.S. PATENT DOCUMENTS

| | | | |
|---|---|---|---|
| 3,303,881 | 2/1967 | Dixon | 166/247 |
| 3,466,094 | 9/1969 | Haworth et al. | 299/13 |
| 3,688,843 | 9/1972 | Nordyke | 166/247 |
| 4,043,596 | 8/1977 | Ridley | 299/2 |
| 4,043,597 | 8/1977 | French | 299/2 |
| 4,043,598 | 8/1977 | French et al. | 299/2 |
| 4,126,272 | 3/1979 | French | 299/2 |
| 4,167,291 | 9/1979 | Ridley | 299/2 |

FOREIGN PATENT DOCUMENTS

| | | | |
|---|---|---|---|
| 47711 | 11/1977 | U.S.S.R. | 299/13 |

OTHER PUBLICATIONS

Redpath, Bruce B., "Application of Cratering Characteristics to Conventional Blast Design", Monograph I on Rock Mechanics Applications in Mining, SME Publication, 1977.

*Primary Examiner*—James A. Leppink
*Assistant Examiner*—George A. Suchfield
*Attorney, Agent, or Firm*—Christie, Parker & Hale

[57] ABSTRACT

A method is provided for recovering shale oil from a subterranean formation containing oil shale. Unfragmented formation is prepared for explosive expansion to form an oil shale retort by excavating at least one limited void in the subterranean formation and forming an array of spaced apart blastholes in the formation. A substantially horizontal array of explosive charges is formed by placing explosive into each blasthole wherein the scaled point charge depth of burial of the explosive charge in each blasthole is substantially equal to the equivalent scaled point charge depth of burial of the array of the explosive charges. Explosive charges are detonated in a single round for explosively expanding the unfragmented formation to form the in situ oil shale retort.

Retorting is commenced and liquid and gaseous products of retorting are withdrawn from the retort.

23 Claims, 4 Drawing Figures

EXPLOSIVE EXPANSION TO A LIMITED VOID WITH UNIFORM SCALED DEPTH OF BURIAL

BACKGROUND OF THE INVENTION

The presence of large deposits of oil shale in the Rocky Mountain region of the United States has given rise to extensive efforts to develop methods for recovering shale oil from kerogen in the oil shale deposits. It should be noted that the term "oil shale" as used in the industry is in fact a misnomer; it is neither shale nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598 which are incorporated herein by this reference. These patents describe in situ recovery of liquid and gaseous hydrocarbon materials from a subterranean formation containing oil shale, wherein such formation is explosively expanded to form a stationary, fragmented permeable body or mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbon products, and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

U.S. Pat. No. 4,043,598 discloses a method for explosively expanding formation containing oil shale toward horizontal free faces to form a fragmented mass in an in situ oil shale retort. According to a method disclosed in that patent, a plurality of vertically spaced apart voids of similar horizontal cross-section are initially excavated one above another within the retort site. A plurality of vertically spaced apart zones of unfragmented formation are temporarily left between the voids. Explosive is placed in each of the unfragmented zones and detonated, preferably in a single round, to explosively expand each unfragmented zone into the voids to form a fragmented mass. Retorting of the fragmented mass is then carried out to recover shale oil from the oil shale.

U.S. Pat. application Ser. No. 929,250 titled "METHOD FOR EXPLOSIVE EXPANSION TOWARD HORIZONTAL FREE FACES FOR FORMING AN IN SITU OIL SHALE RETORT" filed July 31, 1978, now U.S. Pat. No. 4,192,554 by the applicant now U.S. Pat. No. 4,192,554 and assigned to the assignee of the present invention describes a method for forming an in situ oil shale retort by expanding formation toward vertically spaced apart voids. Patent application Ser. No. 929,250 is incorporated herein by this reference.

It is desirable to form an in situ retort with a generally uniformly distributed void fraction, or a fragmented mass of generally uniform permeability so that oxygen-supplying gas can flow relatively uniformly through the fragmented mass during retorting operations. Techniques used for explosively expanding zones of unfragmented formation toward the horizontal free faces of formation adjacent the voids can control the uniformity of particle size or permeability of the fragmented mass. A fragmented mass having generally uniform permeability in horizontal planes across the fragmented mass avoids bypassing portions of the fragmented mass by retorting gas as can occur if there is gas channeling through the mass owing to nonuniform permeability.

One of the factors which affects the distribution of void fraction and uniformity of distribution of the fragmented mass of oil shale particles in an in situ oil shale retort is the blast design used for the explosive expansion.

A method is needed which will optimize the combination of blast design parameters for promoting uniformity of fragmentation and void fraction distribution. The blast design parameters comprise blasthole diameter, spacing between blastholes, size of each explosive charge, location of each explosive charge within the blasthole, and energy of each explosive charge.

SUMMARY OF THE INVENTION

This invention relates to a method for forming an in situ oil shale retort in a subterranean formation containing oil shale. Formation is excavated to form at least one limited void in the subterranean formation, leaving zones of unfragmented formation above and below each void. Each zone of unfragmented formation has a substantially horizontal free face adjoining such a void.

Substantially vertical blastholes are formed in at least one of the zones of unfragmented formation for forming an array of spaced apart blastholes in such a zone of unfragmented formation. A sufficient amount of explosive is placed into each blasthole for forming a substantially horizontal array of explosive charges wherein the scaled point charge depth of burial of the explosive charge in each blasthole is substantially equal to the equivalent scaled point charge depth of burial of the array of explosive charges. The explosive charges are detonated in a single round for explosively expanding the zone of unfragmented formation toward the void to form a fragmented permeable mass of formation particles containing oil shale in the subterranean formation, thereby forming an in situ oil shale retort.

To recover shale oil, gas is introduced into the fragmented permeable mass in the in situ oil shale retort for establishing a retorting zone in the fragmented permeable mass. Oil shale is thereby retorted to produce gaseous and liquid products. The gas also advances the retorting zone through the fragmented mass. Gaseous and liquid products are withdrawn from the retort.

BRIEF DESCRIPTION OF THE DRAWINGS

These and other aspects of the invention will be more fully understood by reference to the following detailed description and accompanying drawings in which.

DETAILED DESCRIPTION

This invention relates to a method for explosively expanding formation toward a limited void in a subterranean formation. More particularly, the invention relates to a method for recovering shale oil from a subterranean formation containing oil shale by optimizing a blast design used in forming an in situ oil shale retort. The use of an optimum blast design enables explosive expansion of unfragmented formation, forming an in situ retort having a reasonably uniformly distributed fragmented permeable mass of formation particles.

Figure 1:
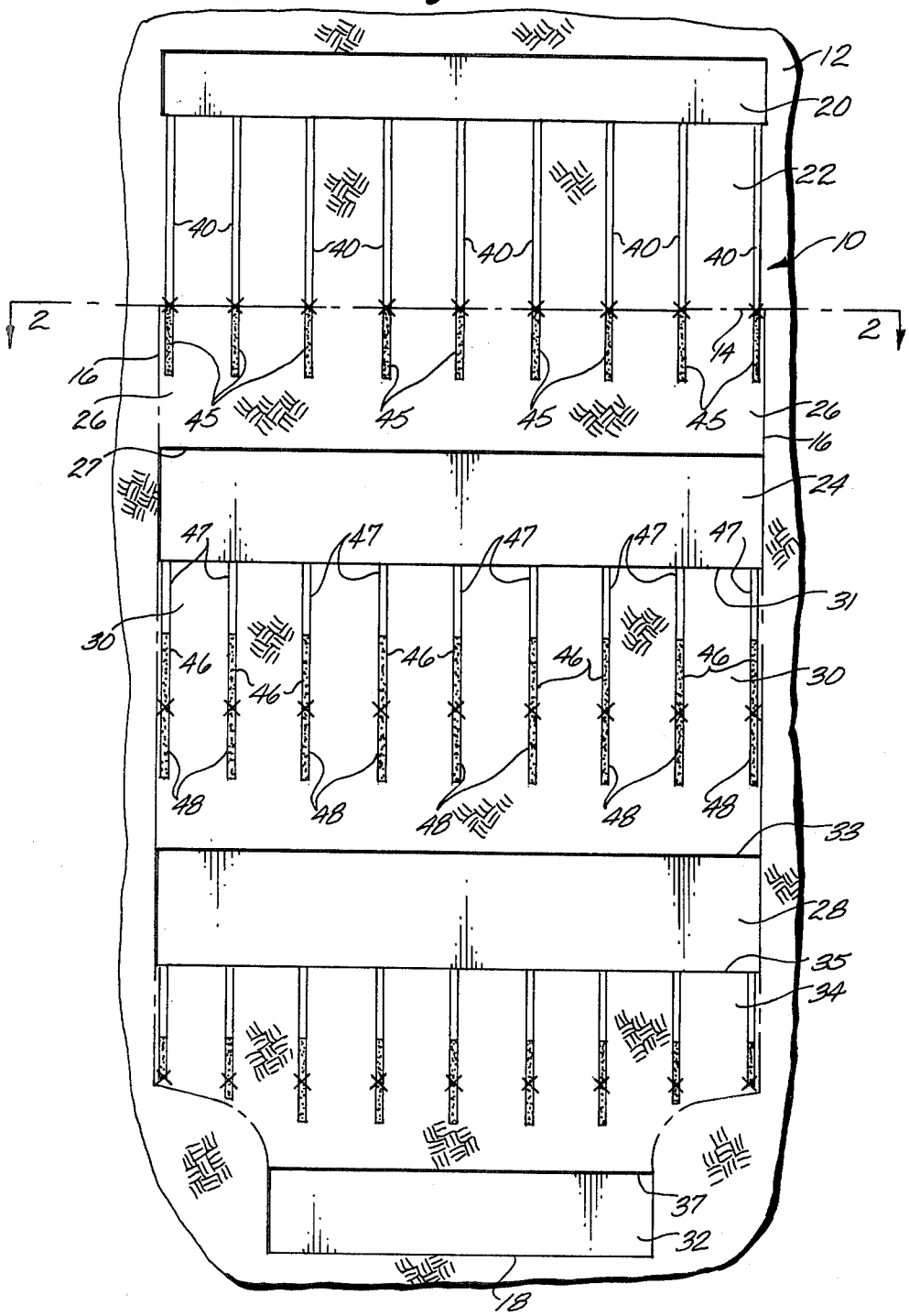
FIG. 1 is a fragmentary, semi-schematic vertical cross-sectional view of a subterranean formation containing oil shale prepared for explosive expansion for forming an in situ retort according to principles of this invention.

The formation of the in situ oil shale retort can be better understood by referring to FIG. 1 which schematically illustrates an in situ oil shale retort 10 being formed in accordance with principles of this invention. FIG. 1 is a semi-schematic, vertical cross-sectional at one stage during preparation of the in situ retort which is being formed in a subterranean formation 12 containing oil shale. The in situ retort is rectangular in horizontal cross-section, having a top boundary 14, four vertically extending side boundaries 16, and a bottom boundary 18.

The in situ retort is formed by a horizontal free face system in which formation is excavated to form at least one limited avoid in the subterranean formation leaving zones of unfragmented formation adjacent such a void. Each such void can extend horizontally across a different level of the retort site, leaving zones of unfragmented formation above and below each void. Each zone of unfragmented formation has a substantially horizontal free face adjoining such a void. One or more pillars of unfragmented formation can be left within each void, if desired, for providing temporary roof support.

In the embodiment illustrated, a portion of the formation within the retort site is excavated on an upper, working level for forming an open base of operation 20 in an air level void. The floor of the base of operation is spaced above the top boundary 14 of the retort being formed, leaving a horizontal sill pillar 22 of unfragmented formation between the floor of the base of operation 20 and the top boundary 14 of the retort being formed.

In the horizontal free face system illustrated in FIG. 1, these vertically spaced apart horizontal voids are excavated within the retort site below the sill pillar 22. A rectangular upper void 24 is excavated at a level spaced vertically below the sill pillar, leaving an upper zone 26 of unfragmented formation extending horizontally across the retort site between the top boundary 14 of the retort being formed and a horizontal free face 27 above the upper void. A rectangular intermediate void 28 is excavated at an intermediate level of the retort being formed, leaving an intermediate zone 30 of unfragmented formation extending horizontally across the retort site between a horizontal free face 31 below the upper void and a horizontal free face 33 above the intermediate void.

A production level void 32 is excavated at a lower production level of the retort being formed, leaving a lower zone 34 of unfragmented formation extending horizontally across the retort site between a horizontal free face 35 below the intermediate void and a horizontal free face 37 above the production level void.

When recovering shale oil from an in situ retort in a subterranean formation, it is desirable to have a reasonably uniform distribution of void fraction in a fragmented mass of oil shale particles in the in situ oil shale retort as well as reasonably uniform fragmentation of such shale oil particles. This promotes uniform permeability and tends to avoid channeling which can reduce the yield of gaseous and liquid products from the retort.

Uniformity in fragmentation and void fraction distribution are promoted by optimizing the "blast design" for explosively expanding the unfragmented formation toward the voids for forming a fragmented permeable mass of oil shale particles. The "blast design" as used herein includes such variables as blasthole diameter, spacing between blastholes, size of each explosive charge, location of the explosive charge within each blasthole, energy of each explosive charge, and other like factors. The blast design can be optimized by using an optimum combination of such variables to form an in situ retort having a reasonably uniform distribution of void fraction and reasonably uniform fragmentation of oil shale particles. Using an optimum blast design becomes particularly important when explosive expansion is toward a limited void, that is, a void having a volume less than the volume required for a free expansion of all the oil shale explosively expanded toward the void. When oil shale is explosively expanded towards an unlimited void, a certain maximum void fraction is present in the fragmented mass resulting from such free expansion. When oil shale is expanded towards a limited void, the void fraction can be no more than permitted by the available void space of the limited void and may be less due to interactions with unfragmented oil shale, for example. It is believed that with oil shale confined by surrounding walls and/or capable of expanding only to such limited void, gases from the detonation of explosive may not have a full opportunity to act upon the expanding oil shale before the oil shale particles reach obstructions, thereby inhibiting mixing and rotation of formation particles.

In order to explosively expand the unfragmented formation toward the limited void to promote uniformity of fragmentation and void fraction distribution, a plurality of substantially vertical blastholes are formed in each zone of unfragmented formation to be explosively expanded. The substantially vertical blastholes can be formed by drilling such blastholes using mining techniques well known in the art. The blastholes formed are generally perpendicular to the free faces of the unfragmented formation.

Explosive is placed into each blasthole to form a two-dimensional array of explosive charges, such explosive charges having their centers of mass approximately in a plane parallel to the free faces. The distance between adjacent explosive charges is sufficiently small that there is full interaction between such explosive charges. The explosive charges are detonated in a single round for explosively expanding the zone or zones of unfragmented formation toward the void to form a fragmented permeable mass of formation particles containing oil shale in the subterranean formation, thereby forming an in situ oil shale retort. The explosive expansion can be downwardly towards an underlying void, upwardly towards an overlying void, or can involve zones of formation both above and below a void expanded simultaneously towards the void. A zone of formation between a pair of vertically spaced apart voids can also be expanded simultaneously towards both such voids.

In practicing principles of this invention, uniformity in fragmentation and void fraction distribution are promoted by improved mixing and bulking of formation particles when explosively expanding the zone or zones of unfragmented formation toward a substantially horizontal free face. A method of improving the mixing and bulking of formation particles comprises optimizing a blast design by placing a sufficient amount of explosive into each blasthole for forming an explosive charge in each blasthole having a scaled point charge depth of burial which is substantially equal to the equivalent scaled point charge depth of burial of the array of explosive charges.

Using an array of explosive charges where the scaled point charge depth of burial of each charge in each blasthole is about equal to the equivalent scaled point charge depth of burial of the array of explosive charges spaces the charges at a distance which provides for optimum interaction between such explosive charges. In addition to the improvement in mixing and bulking of formation particles, the spacing of charges for optimum interaction results in minimizing the criticality of the timing of detonation of each explosive charge. Having time delays, therefore, that are not exact presents only a minimal problem in forming a retort with a reasonably uniform fragmented permeable mass.

Another advantage of using an array of explosive charges where the scaled point charge depth of burial of each charge in each blasthole is about equal to the equivalent scaled point charge depth of burial of the array of explosive charges is that longer time delays can be used between detonation of explosive charges without causing detrimental effects.

The scaled depth of burial as it applies to cratering or blasting to a horizontal free face is described in a paper by Bruce B. Redpath entitled "Application of Cratering Characteristics to Conventional Blast Design", a copy of which accompanies this application and is incorporated herein by reference.

The scaled point charge depth of burial, sdob, of an explosive charge can be expressed in units of distance over weight of explosive to the $\frac{1}{3}$ power or preferably distance over energy of explosive to the $\frac{1}{3}$ power. The distance, referred to as burden distance in the equation for scaled depth of burial, is measured from the free face of the unfragmented formation toward which such unfragmented formation is to be explosively expanded to the center of mass of the explosive charge. The weight or energy of the explosive is the total weight or energy of the column of explosive. The sdob of a point charge, for example, is given by $$sdob = dob/w^{\frac{1}{3}}$$

where dob is the real depth of burial or burden of the charge from the free face and w is the weight of the charge.

A scaled point charge depth of burial can be defined for each explosive charge in each blasthole and, in addition, an equivalent scaled point charge depth of burial can be defined for an array of explosive charges.

The same effective scale point charge depth of burial for an array of explosive charges can be obtained with a variety of patterns of blastholes. For example, the same effective scaled point charge depth of burial of an array can be obtained with either (a) relatively more energetic explosive charges with relatively large spacing between holes, or (b) relatively less energetic explosive charges with relatively smaller spacing between holes.

The scaled point charge depth of burial of an array of explosive charges can be altered by changing the amount of explosive in each blasthole, by changing the actual depth of burial of the explosive charge in each blasthole, by changing the diameter of each blasthole, by using a more or less energetic explosive in each blasthole, and by changing the array of blastholes so that the blastholes are spaced either closer or farther apart.

The effective scaled point charge depth of burial of an array of explosive charges required to explosively expand an entire zone of unfragmented formation toward a limited void which will result in the desired void fraction distribution and uniformly fragmented particles can be determined by cratering tests. It is preferred that once the desired equivalent scaled point charge depth of burial of the array of explosive charges is ascertained, explosive charges are formed in each blasthole of the array, where each explosive charge has a scaled point charge depth of burial substantially equal to the equivalent scaled point charge depth of burial of the array.

Figure 2:
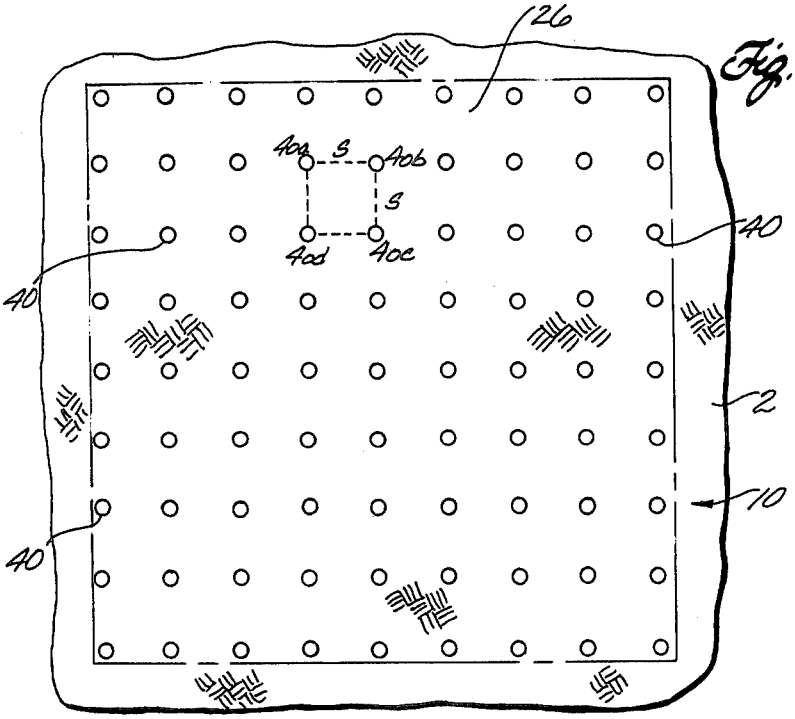
FIG. 2 is a fragmentary, semi-schematic horizontal cross-sectional view taken on line 2—2 of FIG. 1.
Figure 3:
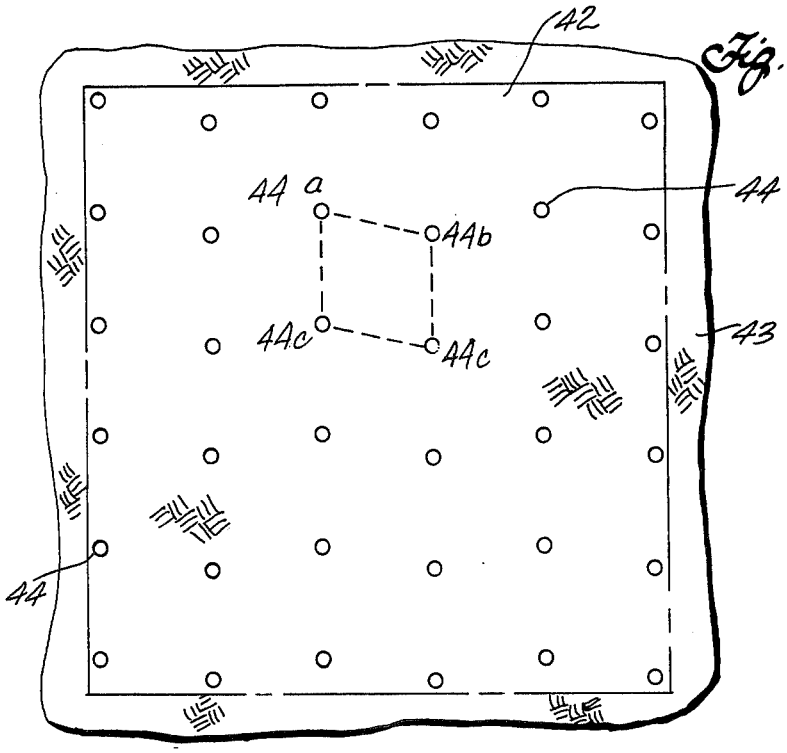
FIG. 3 is a fragmentary, semi-schematic horizontal cross-sectional view of a subterranean formation prepared for explosive expansion.

The array of blastholes formed in the unfragmented formation can have a variety of patterns. It is preferred that the blasthole array have substantially the same shape as the horizontal cross-section of formation to be explosively expanded. For example, if the formation to be expanded has a length equal to the width of such formation, it is preferred that the array used in substantially a square array. If the horizontal cross-section of the formation has a dimension which is longer or shorter than the other dimension, the array, for example, can be a rectangular array other than a square array. A square array, i.e., an array having uniform spacing between blastholes, can also be used in a rectangular retort or in a retort having any other shape. Arrays useful in practicing principles of this invention are illustrated in FIGS. 2 and 3. FIG. 2 is a top view of the upper zone 26 of unfragmented formation showing an array of blastholes 40 drilled into such formation. The blastholes are shown where each four adjacent blastholes define a rectangle. The sides of each rectangle defined by each four adjacent blastholes of the blasthole array can be equal. For example, the in situ retort 10 to be formed has a rectangular horizontal cross-section and it is preferred that a square array of blastholes 40 be formed in such unfragmented formation. The blastholes 40*a*, 40*b*, 40*c*, and 40*d* are shown connected by dashed lines, such dashed lines defining a square. It is preferred that the array be symmetrical, i.e., each square of such a square array of blastholes have sides substantially equal in length to the sides of each other square formed by each four adjacent blastholes in such blasthole array.

Where blasthole arrays are used having rectangles defined by each four adjacent blastholes and the sides are not equal, it is preferred that the length of a side of each rectangle so defined is no less than about 75% of the length of another side of each such rectangle to provide for proper interaction between explosive charges in the blastholes. It is further preferred that the array be symmetrical, i.e., that each of the rectangles of such a rectangular array have dimensions substantially equal to each of the other rectangles of the array.

Although it is more convenient to use rectangular or square arrays of spaced apart blastholes due to the shape of the retort to be formed, arrays can be used where the blastholes are offset, as shown in FIG. 3. FIG. 3 is a top view of a zone of unfragmented formation 42 in a subterranean formation 43 having been prepared for explosive expansion by having an array of substantially vertical blastholes 44 drilled into such zone of unfragmented formation. The blasthole array comprises blastholes wherein each four adjacent blastholes define a quadrilateral, for example, blastholes 44*a*, 44*b*, 44*c*, and 44*d* are shown connected by a dashed line where all the interior angles formed by the lines are other than 90°. When a quadrilateral array of blastholes is used, the shortest side of each quadrilateral group formed by adjacent blastholes of such blastholes array is equal to at least about 75% of the longest side.

It should be noted that when using a square array of blastholes, there can be some blastholes which are located such that each quadrilateral defined by four adjacent blastholes is not quite a square. This can be due to obstacles encountered in the drilling operation.

In the preferred embodiment using a square array of spaced apart blastholes, the scaled point charge depth of burial of each explosive charge is made equal to the equivalent scaled point charge depth of burial of the array of explosive charges by forming each explosive charge wherein the actual depth of burial of each charge, i.e., the distance from the substantially horizontal free face to the center of mass of each charge, is about the same as the "spacing distance". "Spacing distance" is defined as the square root of the product of the length times the width of the quadrilateral defined by any four adjacent blastholes of the blasthole array. When using a square array of blastholes, for example, the spacing distance is equal to the length of a side of the square formed by each four adjacent blastholes in such a square blasthole array. The preferred relationship of the actual depth of burial of each explosive charge to the spacing distance can be explained by the scaling formulas as are presented in the paper by Redpath incorporated hereinabove by reference.

The scaling law for an explosive point charge is well known and has been derived analytically and verified experimentally. This point charge relation can be written as:

$$sdob_{pt}=dob_{pt}/W^{\frac{1}{3}}$$

or $$dob_{pt}=sdob_{pt}\cdot W^{\frac{1}{3}} \quad (1)$$

where $dob_{pt}$ = actual point charge depth of burial (in feet, for example);

W = charge weight (in pounds, for example);

$sdob_{pt}$ = scaled point charge depth of burial (ft/lb$^{\frac{1}{3}}$).

A similar equation that can be written for a plane charge geometry appears as:

$$dob_{pl}=sdob_{pl}\cdot(W/s^2) \quad (2)$$

wherein pl denotes plane and wherein the explosive charge is considered to form a substantially horizontal plane parallel to the free face and located in the unfragmented formation to be explosively expanded and $W/s^2$ in the charge weight per unit area of such plane explosive charge. To ensure dimensional correctness, these relations show that:

$$sdob_{pt}=(l^3/w)^{\frac{1}{3}}$$

$$sdob_{pl}=(l^3/w)^1 \quad (3)$$

where l is a linear dimension and w is a charge weight. Note that $sdob_{pl}$ is the inverse of a powder factor (PF), where powder factor is the weight of an explosive charge per unit volume of formation explosively expanded. In the above equation, the plane charge need not be continuous, but can consist of separate cylindrical charges in blastholes of a blastholes array such as arrays as described hereinabove.

Point and plane charges will provide equivalent effects if they have the same powder factor or value of $(l^3/w)$. From equation (3) this means that:

$$sdob_{pt}^3=sdob_{pl}. \quad (4)$$

The most useful equation is relating the scaled point charge depth of burial of explosive in each blasthole to the equivalent scaled point charge depth of burial of the array of explosive charges results when equation (4) is placed into equation (2) for providing:

$$dob_{pl}=sdob_{pt}^3\cdot(W/s^2) \quad (5)$$

which relates the scaled point charge dob, weight per unit area, and actual plane dob. Equation (5) can be used in two ways:

(a) Given a blast array using cylindrical explosive charges as described above, one can calculate directly $(W/s^2)$, actual $dob_{pl}$, and the equivalent point charge $sdob_{pt}$ of the array of explosive charges using the relation $$sdob_{pt}=[dob_{pl}/W/s^2)]^{\frac{1}{3}}. \quad (6a)$$

(b) Given a scaled point charge dob that one wants to simulate using a blast array having cylindrical explosive charges, one can first calculate $sdob_{pt}^3$, and then knowing the scale of the blasthole array that can be used (for example, the depth of blastholes, size of blastholes, and types of explosive to be used) calculation of $dob_{pl}$ and w, where w is the charge weight per hole can be completed. s then represents the required hole spacing or spacing distance between cylindrical explosive charges to simulate the equivalent point charge, and can be calculated using the equation:

$$s=[W\cdot sdob_{pt}^3/dob_{pl}]^{\frac{1}{2}}. \quad (6b)$$

These equations are valid for the square array of spacing s by s where s is the distance between adjacent blastholes as shown in FIG. 2. If a rectangular or quadrilateral array is used, the spacing between blastholes should be used so that the product of the length of a side times the length of another side as described hereinabove is equal to the value of $s^2$ from (6b).

Choosing one spacing distance, for example, $s_1$, allows calculation of the other spacing distance, $s_2$, directly from $$s_1\cdot s_2=s^2=W\cdot sdob_{pt}^3/dob_{pl}. \quad (6c)$$

As described hereinabove, the preferred blast design result arises when the scaled point charge depth of burial for the individual charge in each blasthole in an array is equal to the equivalent scaled point charge depth of burial for the entire array of explosive charges. In the following equations, all of the depths of burials (dob's) will be point charge dob's, so the subscript "pt" will be dropped. The scaled point charge depth of burial for an individual charge within an array is given by:

$$sdob_{indiv}=DOB/W^{\frac{1}{3}} \quad (7a)$$

where DOB is the depth from the substantially horizontal free face to the center of mass of the explosive charge, and W is the individual charge weight. In all of the calculations, the blasthole length will be considered to extend through only the unfragmented formation to be explosively expanded toward the nearest free face. In addition, the charge length of the explosive charge is equal to one-half of the thickness of the unfragmented formation to be explosively expanded. The charge is placed in the blasthole so as to occupy a position in such a blasthole most remote from the free face toward which the unfragmented formation is to be explosively expanded. This has been shown to be the most effective configuration for a given thickness of unfragmented formation to be explosively expanded. Thus, the actual depth of burial related to the total hole depth, D, or thickness of unfragmented formation to be explosively expanded will always remain fixed at DOB=0.75 D.

The equivalent scaled point charge depth of burial for the entire array is obtained from equation (6a) and appears as $$sdob_{array}=(DOB\cdot s^2)^{\frac{1}{3}}/W^{\frac{1}{3}} \quad (7b)$$

where the actual array depth of burial, DOB, is equal to the actual individual charge depth of burial, also denoted by DOB. W is again the charge weight per hole in the array which is the same as in equation (7a).

Therefore, looking at (7a) and (7b), the scaled point charge depth of burial of the explosive charge in each individual blasthole of the array is equal to the equivalent scaled point charge depth of burial of the array when the spacing distance is equal to the actual depth of burial, i.e., when s=DOB.

Where the spacing distance is appreciably less than the actual column charge DOB, the array will produce greater powder factor effects, such as finer breakage and higher surface velocities than would an individual charge within the array. This effect can be attributed to a dynamic interaction and enhancement between the charges, but it is at the expense of inefficient array spacing compared to an array where spacing distance is about equal to the actual depth of burial of each explosive charge. With respect to fragmentation, since the closer spacing results in smaller particle size than desired, the spacing distance S could be increased to deepen the equivalent scaled point charge dob of the array.

When, for example, the scaled point charge depth of burial of each charge is initially greater than the equivalent scaled point charge depth of burial of the array, less than desired mixing and rotation of particles can result. The scaled point charge depth of burial of each blasthole in the array can be decreased to be equal to the equivalent scaled point charge depth of burial of the array, for example, by increasing the energy of the explosive charge in each blasthole. When the energy of each explosive charge in each blasthole is increased, the spacing distance between blastholes is increased to maintain the same powder factor and equivalent scaled point charge depth of burial for the array. This results in less blastholes being used which can improve the economics of the operation. Additionally, each crater formed by each explosive charge in each blasthole has a larger angle between a vertical plane through the center of such a crater and the sides of the crater. This increases the tendency of the oil shale to be thrown laterally by the explosive and results therefore in better mixing, rotation, and bulking of such oil shale particles. It should be noted that in certain applications, due to physical or seismic constraints, for example, it may be necessary to use the more inefficient blasting schemes to provide the desired results.

Where the spacing distance is greater than the actual charge depth of burial, the array would appear to be deeper than the individual charges and would produce smaller powder factor effects than would an individual charge within the array. This would suggest too wide a spacing in the array, which could result in separate craters around each charge and not the uniform, continuous fragmentation desired for forming an in situ oil shale retort having a substantially uniformly distributed fragmented permeable mass of oil shale particles.

Where the spacing distance is equal to the actual column charge depth of burial, and the scaled point charge depth of each explosive charge in each blasthole is equal to the equivalent scaled point charge depth of burial of the array of explosive charges, the array produces the same powder factor effects as does an individual charge within the array. Since the equivalent scaled point charge depth of burial of the array equals the scaled point charge depth of burial of each blasthole, this would suggest that each charge could be treated independently from the others and still give the same overall result. Thus, this will minimize any problems with time delays in the round not being exact and each charge can be shot essentially independently with the result the same as if all the charges were shot instantaneously. This case might be considered as just at the onset of dynamic interaction between charges and represent the most efficient, or optimal, spacing between charges.

It is, therefore, preferred that the spacing distance be made about the same as the actual depth of burial of the explosive charge in each blasthole for providing an array of explosive charges wherein the scaled point charge depth of burial of the explosive charge in each blasthole is substantially equal to the equivalent scaled point charge depth of burial of the array of explosive charges.

It is preferred when optimizing a blast design that initially the desired equivalent scaled point charge depth of burial of the array of explosive charges be determined which will provide sufficient energy to fragment the entire zone of unfragmented formation to be explosively expanded. For example, when explosively expanding the entire upper zone of unfragmented formation 26 toward the upper void 24, sufficient explosive is placed into each blasthole 40 to explosively expand the unfragmented formation between the substantially horizontal free face 27 above the upper void and a substantially horizontal plane passing through explosive charges at a location most remote from the free face, i.e., at the top boundary 14 of the in situ oil shale retort being formed. The desired equivalent scaled point charge depth of burial can be determined by cratering tests. It has been found that when explosively expanding oil shale formation, a scaled point charge depth of burial can be used ranging from about 8 mm per calorie to the $\frac{1}{3}$ power to about 12 mm per calorie to the $\frac{1}{3}$ power. Using scaled point charge depths of burial within this range has been found to provide sufficient energy to explosively expand the formation providing an acceptable mixing and rotation of particles having an acceptable size distribution.

Once the desired equivalent scaled point charge depth of burial of an array of explosive charges has been ascertained, the blast design can be completed. As described hereinabove, the preferred blast design provides each blasthole in the array with an explosive charge having a scaled point charge depth of burial which is substantially equal to the desired equivalent scaled point charge depth of the array.

Several basic parameters of blast design are substantially fixed and must be taken into consideration prior to defining the other blast design parameters. For example, in loading each blasthole for explosive expansion of unfragmented formation, it is preferred that the charge length is equal to about $\frac{1}{2}$ the height or thickness of the unfragmented formation to be explosively expanded. This can be better understood by referring to FIG. 1. The charge length of the explosive charges 45 in the upper zone of unfragmented formation 26 extends from the top boundary 14 about half the distance toward the substantially horizontal free face 27 above the upper void, e.g., about 17.5 feet for a zone about 35 feet thick. Thus, the center of mass of each explosive charge in the upper zone of unfragmented formation is at about 26174 feet from the free face 27 above the upper void.

Where the zone of unfragmented formation is between a pair of vertically spaced apart voids and is to be explosively expanded toward both voids, the explosive charges can be as shown in the intermediate zone of unfragmented formation 30. The explosive in the intermediate zone of unfragmented formation forms a column in each blasthole 47 drilled into the intermediate zone of formation which extends about half the thickness of the unfragmented formation to be explosively expanded, e.g., about 35 feet, for a 70-foot thick zone. Each column of explosive has a detonator placed at about the center of height of such column of explosive. The column of explosive in each blasthole of the intermediate zone thereby forms what is equivalent to two explosive charges where the detonation of the top explosive charge 46 above the detonator is toward the horizontal free face 31 below the upper void and the detonation of the bottom explosive charge 48 below the detonator is toward the horizontal free face 33 above the lower void. The charge length of the top explosive charge 46 is about 17.5 feet, the center of mass of the top explosive charge is about 26-$\frac{1}{4}$ feet below the horizontal free face 31 below the upper void. The top explosive charge 46 is used for expanding the top 35 feet of the intermediate zone of unfragmented formation toward the upper void 24.

The charge length of the bottom explosive charge 48 is about 17.5 feet, the center of mass of the bottom explosive charge is about 26$\frac{1}{4}$ feet above the horizontal free face 33 above the intermediate void. The bottom explosive charge 48 is used for expanding the bottom 35 feet of the intermediate zone of unfragmented formation toward the intermediate void 21.

The lower zone of unfragmented formation is prepared for explosive expansion by using principles substantially identical to those principles used in the preparation of the upper zone of unfragmented formation.

The thickness of the zone of unfragmented formation to be explosively expanded, therefore, can define both the length of the explosive charge and the depth of burial of such explosive charge.

The determination of the remaining blast design parameters can be understood by evaluating the blast design for the explosive expansion of the upper zone 26 of unfragmented formation in an exemplary embodiment.

The equivalent scaled point charge depth of burial of an array of explosive charges desired for the explosive expansion of the entire upper zone 26 of unfragmented formation into the upper void 24 can, for example, be about 8.5 mm per calorie to the $\frac{1}{3}$ power as determined by cratering tests. The thickness of the formation to be expanded is about 35 feet and the actual depth of burial of each explosive charge will, therefore, be at about 26$\frac{1}{4}$ feet as described above. The preferred spacing distance of the square array of blastholes to be formed in the upper zone of unfragmented formation is, therefore, about 26-$\frac{1}{4}$ feet. This spacing distance equals the actual depth of burial of each explosive charge in each blasthole and is required to provide a scaled point charge depth of burial in each blasthole equal to the desired equivalent point charge depth of burial of the array of explosive charges of 8.5 mm per calorie to the $\frac{1}{3}$ power.

Using equation (*7b*), defined hereinabove, the charge weight, W, for a given explosive required in each blasthole to give the desired scaled point charge depth of burial for each explosive charge is determined. The blasthole diameter is thereafter calculated using the given explosive to provide an explosive charge in each blasthole having a charge length of 17.5 feet and a charge weight, W, as determined from formula (7*b*).

The determination of blasthole diameter to accommodate an explosive charge of a given energy can differ from commercially available drill diameters. The next larger diameter drill bit is chosen to provide a conservative margin to assure proper explosive charge interaction in the array. If desired, the blastholes can be placed somewhat closer together than the mathematically determined preferred spacing to accommodate geometric constraints due to the retort configuration, to accommodate geologic conditions and/or to provide an increased margin of reliability.

The square array of blastholes 40 having a spacing distance of up to about 26¼ feet and the required blasthole diameter is drilled into the upper zone 26 of unfragmented formation. Explosive is placed into the blastholes forming the preferred array of explosive charges wherein the scaled point charge depth of burial of the explosive charge in each blasthole is substantially equal to the equivalent scaled point charge depth of burial of the array.

It should be noted that if a substantially rectangular array other than a square array is used in the upper zone of unfragmented formation, the spacing distance, i.e., the square root of the length times the width of each rectangle, is made equal to about 26¼ feet. Further, the short side of such a rectangle is preferred to be equal to at least about 75% of the length of the long side of each such rectangle so that there is provided proper interaction between explosive charges in the blastholes. A combination of blasthole diameter and energy of explosive used is chosen for the rectangular array as described hereinabove for the square array.

Explosive is placed into each of the other zones of unfragmented formation by using a substantially identical procedure as that used for the upper zone of unfragmented formation.

There are several additional variables that can be taken into consideration when optimizing a blast design. For example, when loading each of the substantially vertical blastholes in the upper zone 26 of unfragmented formation, it is preferred that the explosive charges have a charge length to diameter ratio of at least about 20. For example, where the blastholes drilled into the upper zone of unfragmented formation 26 have a diameter of about 10 inches and the charge length of the explosive charge in each blasthole is about 17.5 feet, the charge length to diameter ratio is equal to about 21. It is believed that when the charge length to diameter ratio is less than about 6, the charge acts more like a point charge than a columnar charge. The columnar charge is preferred when blasting to two free faces, as in the intermediate zone of unfragmented formation described above. The columnar charge is preferred because if there is any discontinuity in the unfragmented formation, a greater portion of the energy from detonation of the point charge is directed toward the free face having a path of least resistance from the location of the charge to such a free face. Therefore, by using a charge length to diameter ratio of less than about 6, explosive expansion or unfragmented formation can occur that is not uniform toward both free faces, thereby forming an in situ oil shale retort having a substantially non-uniform fragmented permeable mass. A column charge having a length to diameter ratio of at least about 20 is appreciably more "forgiving" with respect to actual field conditions than charges with smaller ratios. Field conditions for blasting are less than ideal due to vagaries in drilling, loading, and detonating blastholes and differences in rock properties in various regions of the zone of unfragmented formation. Column charges with a substantial length to diameter ratio are least affected by such factors.

The fragmented permeable mass of oil shale particles is thereafter formed by detonating the explosive charges placed into the blastholes in a single round for explosively expanding the zones of unfragmented formation toward the voids to form a fragmented permeable mass of formation particles containing oil shale in the subterranean formation for forming an in situ oil shale retort.

Figure 4:
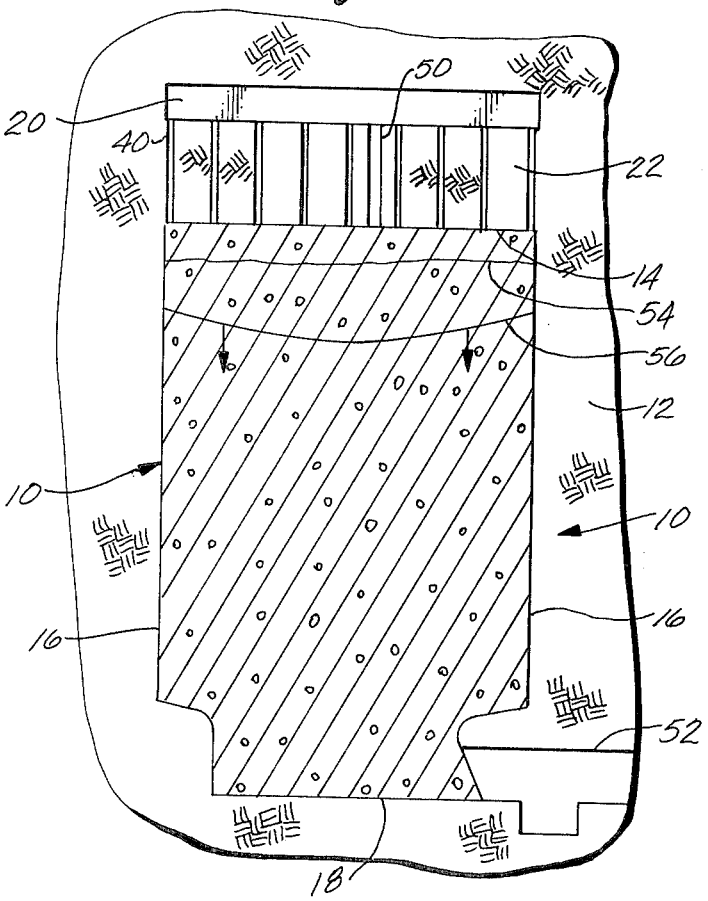
FIG. 4 is a semi-schematic vertical cross-sectional view of an oil shale retort formed for recovering shale oil according to principles of this invention.

After having formed the fragmented permeable mass of oil shale particles in an oil shale retort as illustrated in FIG. 4, the final preparation steps for producing liquid and gaseous products from the retort are carried out. These steps include drilling at least one gas feed inlet passage 50 downwardly from the base of operation 20 to the top boundary 14 of unfragmented formation so that oxygen-supplying gas can be introduced into the fragmented mass during the retorting operations. Alternatively, at least a portion of the blastholes through the sill pillar 22 can be used for introduction of the oxygen-supplying gas. Alternatively, the upper boundary of the retort can be adjacent the upper level void 12 and the sill pillar 22 also explosively expanded. In such an embodiment, a retort inlet mixture is introduced from an overlying or laterally adjacent drift. A separate substantially horizontal product withdrawal drift 52 extends away from the lower portion of the fragmented mass at the lower production level. The product withdrawal drift 52 is used for removal of liquid and gaseous products of retorting.

During retorting operations, a combustion zone 54 is established in the fragmented permeable mass and the combustion zone is advanced downwardly through such fragmented mass by introduction of the oxygen-supplying gas into the retort. Combustion gas produced in the combustion zone passes through the fragmented mass to establish a retorting zone 56 on the advancing side of the combustion zone wherein kerogen in the oil shale is retorted to produce liquid and gaseous products of retorting. The liquid products and an off gas containing gaseous products pass to the bottom of the fragmented mass and are withdrawn from product withdrawal drift. A pump (not shown) is used to withdraw liquid products from the sump to above ground. Off gas is withdrawn by a blower (not shown) and passed to above ground.

The above description of a method for recovering oil shale from a subterranean formation containing oil shale including the description of preparing the zones of unfragmented formation for explosive expansion is for illustrative purposes. Because of variations which will be apparent to those skilled in the art, the present invention is not intended to be limited to the particular embodiment described above. The scope of the invention is defined in the following claims.

What is claimed is:

1. A method for recovering shale oil from a subterranean formation containing oil shale which comprises the steps of:

excavating formation to form at least one limited void in the subterranean formation, leaving zones of unfragmented formation above and below such a void, such a zone of unfragmented formation having a substantially horizontal free face adjoining the void;

forming substantially vertical blastholes in at least one of such zones of unfragmented formation for forming an array of spaced apart blastholes in such a zone;

placing a sufficient amount of explosive into each blasthole for forming a substantially horizontal array of explosive charges wherein the scaled point charge depth of burial of the explosive charge in each blasthole is substantially equal to the equivalent scaled point charge depth of burial of the array of explosive charges;

detonating the explosive charges in a single round for explosively expanding such a zone of unfragmented formation toward the void to form a fragmented permeable mass of formation particles containing oil shale in the subterranean formation for forming an in situ oil shale retort;

introducing gas into the fragmented permeable mass in the in situ oil shale retort for establishing a retorting zone in the fragmented permeable mass wherein oil shale is retorted to produce gaseous and liquid products, and for advancing the retorting zone through the fragmented mass; and withdrawing gaseous and liquid products from the retort.

2. The method according to claim 1 comprising forming columnar explosive charges in each blasthole, such explosive charges having a charge length about one-half the thickness of such a zone of unfragmented formation which is to be expanded towards such a free face.

3. The method according to claim 1 comprising forming the array of explosive charges wherein such array has an equivalent scaled point charge depth of burial in the range of from about 8 millimeters to about 12 millimeters per calorie to the $\frac{1}{3}$ power.

4. The method according to claim 1 comprising forming a rectangular array of blastholes wherein the length of a side of each rectangle formed by each four adjacent blastholes is no less than about 75% of the length of another side of such rectangle.

5. The method according to claim 4 comprising forming blastholes for providing a rectangular array which is substantially a square array.

6. The method according to claim 1 comprising forming each explosive charge with a charge length to diameter ratio of at least about 20.

7. The method according to claim 1 comprising forming explosive charges in each blasthole, each such explosive charge having a center of mass at about the same depth in such a zone of unfragmented formation which is to be expanded toward such a free face.

8. A method for forming an in situ oil shale retort within a subterranean formation containing oil shale, such an in situ oil shale retort containing a fragmented permeable mass of formation particles containing oil shale comprising the steps of:

excavating formation to form at least one limited void in the subterranean formation, leaving zones of unfragmented formation above and below such a void, such a zone of unfragmented formation having a substantially horizontal free face adjoining the void;

forming substantially vertical blastholes in at least one of such zones of unfragmented formation for forming an array of spaced apart blastholes in such a zone of unfragmented formation;

placing explosive into each blasthole for forming a substantially horizontal array of explosive charges wherein the scaled point charge depth of burial of the explosive charge in each blasthole is substantially equal to the equivalent scaled point charge depth of burial of the array of explosive charges; and detonating the explosive charges in a single round for explosively expanding such a zone of unfragmented formation toward the void to form a fragmented permeable mass of formation particles containing oil shale in the subterranean formation for forming an in situ oil shale retort.

9. The method according to claim 8 comprising forming the array of explosive charges where such array has an equivalent scaled point charge depth of burial equal to about 8 millimeters to about 12 millimeters per calorie to the $\frac{1}{3}$ power.

10. The method according to claim 8 comprising forming each explosive charge with a charge length to diameter ratio of at least about 20.

11. The method according to claim 8 comprising forming explosive charges in each blasthole, each such explosive charge having a center of mass at about the same depth in such a zone of unfragmented formation which is to be expanded toward such a free face.

12. A method of explosively expanding formation toward a limited void in a subterranean formation which comprises the steps of:

excavating formation to form at least one limited void in the subterranean formation, leaving zones of unfragmented formation above and below such a void, such a zone of unfragmented formation having a substantially horizontal free face adjoining the void;

forming substantially vertical blastholes in at least one of such zones of unfragmented formation for forming a substantially square array of spaced apart blastholes in such a zone of unfragmented formation;

placing explosive into each blasthole forming an explosive charge in each blasthole, such an explosive charge having a charge length about one-half the thickness of such a zone of unfragmented formation which is to be expanded towards such a free face, such an explosive charge having a charge length to diameter ratio of at least about 20, such explosive charges forming an array of explosive charges wherein the scaled point charge depth of burial of the explosive charge in each blasthole is substantially equal to the equivalent scaled point charge depth of burial of the array of explosive charges, such scaled point charge depth of burial being equal to about 8 millimeters to about 12 millimeters per calorie to the $\frac{1}{3}$ power; and detonating the explosive charges in a single round for explosively expanding such a zone of unfragmented formation toward the void to form a fragmented permeable mass of formation particles containing oil shale in the subterranean formation forming an in situ oil shale retort.

13. The method according to claim 12 comprising forming explosive charges in each blasthole, each such explosive charge having a center of mass at about the same depth in such a zone of unfragmented formation which is to be expanded toward such a free face.

14. A method for forming an in situ oil shale retort within a subterranean formation containing oil shale, such an in situ oil shale retort containing a fragmented permeable mass of formation particles containing oil shale comprising the steps of:

excavating formation to form at least one limited void in the subterranean formation, leaving zones of unfragmented formation above and below such a void, such a zone of unfragmented formation having a substantially horizontal free face adjoining the void;

forming substantially vertical blastholes in at least one of such zones of unfragmented formation for forming an array of spaced apart blastholes in such a zone;

placing an amount of explosive into each blasthole for providing explosive charges in each blasthole having sufficient energy to fragment substantially the entire zone of unfragmented formation between the free face of such unfragmented formation towards which the unfragmented formation is being explosively expanded and a substantially horizontal plane passing through such explosive charges at a location most remote from such a free face, such explosive charges having a spacing between adjacent charges no more than about the actual depth of burial of such explosive charges; and detonating the explosive charges in a single round for explosively expanding such a zone of unfragmented formation toward the void to form a fragmented permeable mass of formation particles containing oil shale in the subterranean formation forming an in situ oil shale retort.

15. The method according to claim 14 comprising forming explosive charges in each blasthole, such explosive charges having a charge length about one-half the thickness of such a zone of unfragmented formation which is to be expanded towards such a free face.

16. The method according to claim 14 comprising forming an array of explosive charges wherein such array has an equivalent scaled point charge depth of burial equal to about 8 millimeters to about 12 millimeters per calorie to the $\frac{1}{3}$ power.

17. The method according to claim 14 comprising forming an array of blastholes which is a rectangular array wherein the length of each side of each rectangle formed by each four adjacent blastholes is no less than about 75% of the length of another side of such rectangle.

18. The method according to claim 17 comprising forming blastholes for providing an array which is substantially a square array.

19. The method according to claim 14 comprising forming each explosive charge with a charge length to diameter ratio of at least about 20.

20. The method according to claim 14 comprising forming explosive charges in each blasthole, each such explosive charge having a center of mass at about the same depth in such a zone of unfragmented formation which is to be expanded toward such a free face.

21. A method for forming an in situ oil shale retort within a subterranean formation containing oil shale, such an in situ oil shale retort containing a fragmented permeable mass of formation particles containing oil shale comprising the steps of:

excavating formation to form at least one limited void in the subterranean formation, leaving zones of unfragmented formation above and below such a void, such a zone of unfragmented formation having a substantially horizontal free face adjoining the void;

forming substantially vertical blastholes in at least one of such zones of unfragmented formation forming a substantially square array of spaced apart blastholes in such a zone;

placing an amount of explosive into each blasthole for providing explosive charges having sufficient energy to fragment substantially the entire zone of unfragmented formation between the free face of such unfragmented formation towards which the unfragmented formation is being explosively expanded and a substantially horizontal plane passing through such explosive charges at a location most remote from such a free face, such an explosive charge having an actual depth of burial that is about the same as the spacing distance, a scaled point charge depth of burial equal to about 8 millimeters to about 12 millimeters per calorie to the $\frac{1}{3}$ power, and such an explosive charge having a charge length about one-half the thickness of such a zone of unfragmented formation which is to be expanded toward such a free face; and detonating the explosive charges in a single round for explosively expanding such a zone of unfragmented formation toward the void to form a fragmented permeable mass of formation particles containing oil shale in the subterranean formation forming an in situ oil shale retort.

22. The method according to claim 21 comprising forming each explosive charge with a charge length to diameter ratio of at least about 20.

23. The method according to claim 22 comprising forming explosive charges in each blasthole, each such explosive charge having a center of mass at about the same depth in such a zone of unfragmented formation which is to be expanded toward such a free face.

* * * * *

UNITED STATES PATENT AND TRADEMARK OFFICE

CERTIFICATE OF CORRECTION

PATENT NO. : 4,245,865

DATED : January 20, 1981

INVENTOR(S) : Thomas E. Ricketts

It is certified that error appears in the above—identified patent and that said Letters Patent is hereby corrected as shown below:

Column 3, line 57, delete "cross-sectional" and insert therefor -- cross-section --; line 66, delete "avoid" and insert therefor -- void --. Column 4, line 18, delete "these" and insert therefor -- three --. Column 7, line 51, delete "blastholes" and insert therefor -- blasthole --. Column 8, line 48, delete "blastholes" (second occurrence) and insert therefor -- blasthole --. Column 11, line 67, delete "26174" and insert therefor -- 26-1/4 --.

Signed and Sealed this

*Twelfth* Day of *May 1981*

[SEAL]

*Attest:*

RENE D. TEGTMEYER

*Attesting Officer*

*Acting Commissioner of Patents and Trademarks*

UNITED STATES PATENT AND TRADEMARK OFFICE

CERTIFICATE OF CORRECTION

PATENT NO. : 4,245,865

DATED : January 20, 1981

INVENTOR(S) : Thomas E. Ricketts

It is certified that error appears in the above-identified patent and that said Letters Patent is hereby corrected as shown below:

Change "scaled point charge" to -- point charge scaled -- in each of the following locations: In the Abstract at lines 9 and 11; column 5, line 48; column 5, line 50; column 5, lines 52 and 53; column 5, lines 54 and 55; column 5, line 66; column 5, line 68; column 6, line 10; column 6, line 28; column 6, line 30; column 6, line 32; column 6, line 35; column 6, line 41; column 6, line 50; column 6, line 60; column 6, line 61; column 8, lines 56 and 57; column 8, line 58; column 8, line 63; column 9, line 6; column 9, line 34; column 9, lines 36 and 37; column 9, line 40; column 9, line 64; column 10, lines 6 and 7; column 10, line 9; column 10, line 26; column 10, line 28; column 10, line 30; column 10, line 32; column 10, lines 37 and 38; column 10, lines 62 and 63; column 10, line 64; column 10, lines 67 and 68; column 11, lines 15 and 16; column 11, lines 17 and 18; column 11, line 21; column 11, lines 34 and 35; column 11, line 40; column 11, line 45; column 11, line 50; column 11, lines 51 and 52; column 13, line 20, column 13, line 22; column 15, lines 9 and 10; column 15, line 12; column 15, line 35; column 16, line 3; column 16, line 5; column 16, line 16; column 16, line 49; column 16, lines 51 and 52; column 16, line 53; column 17, line 43; column 17, line 43; column 18, lines 34 and 35.

Signed and Sealed this

Tenth Day of April 1984

[SEAL]

Attest:

GERALD J. MOSSINGHOFF

Attesting Officer

Commissioner of Patents and Trademarks